United States Patent [19]

Deacy

[11] Patent Number: 4,465,468

[45] Date of Patent: Aug. 14, 1984

[54] UNDERWATER VIEWING DEVICE

[76] Inventor: Edward F. Deacy, Box 413, Cruz Bay, St. John, V.I. 00830

[21] Appl. No.: 434,477

[22] Filed: Oct. 15, 1982

[51] Int. Cl.[3] ..... B63C 11/48

[52] U.S. Cl. ..... 441/135; 114/66; 272/1 B; 2/171.3

[58] Field of Search ..... 441/135, 136; 114/66; 2/171.3, 181.6, 206, 173; D2/234; 272/1 B; 405/186, 185

[56] References Cited

U.S. PATENT DOCUMENTS

| | | | |
|---|---|---|---|
| 735,790 | 8/1903 | Meerza | 2/171.3 |
| 3,081,726 | 3/1963 | Betts et al. | 441/135 |
| 3,825,953 | 7/1974 | Hunter | D2/234 |
| 4,145,783 | 3/1979 | Rhodes | 441/135 |

FOREIGN PATENT DOCUMENTS

| | | | |
|---|---|---|---|
| 2537436 | 1/1977 | Fed. Rep. of Germany | 441/135 |

*Primary Examiner*—Trygve M. Blix
*Assistant Examiner*—Patrick W. Young
*Attorney, Agent, or Firm*—Quaintance & Murphy

[57] ABSTRACT

An underwater viewing device in the form of a generally rectangular, open topped, one-piece, transparent container having a flexible pad at the open top for the face of the user, ventilation openings formed through the upper front and rear walls of the device, and a pair of handles in the form of squeezable bulbs attached to tubing lengths extended into the forward, bottom area of the container. Periodic squeezing of the handles causes air to be drawn through the front vent, circulated to the rear of the container, and exhausted through the rear vent.

4 Claims, 2 Drawing Figures

UNDERWATER VIEWING DEVICE

BACKGROUND OF THE INVENTION

This invention relates generally to apparatus for observing objects under water, and more particularly to an underwater viewing device in the form of an open-top, transparent container of uncomplicated structure which requires literally no training to be used and which, when released, floats in an upright, stable attitude.

Prior art apparatus of the type under discussion is generally divided into two categories. In the first category are a wide variety of diving masks. A conventional diving mask has a transparent face plate and a rubber body which is secured to the user's head by means of a rubber strap. A snorkel for breathing may be built into the mask or, more commonly, is attached to the strap. Some skill and a degree of training is required to use a diving mask successfully and often it is difficult for a user or swimmer to find a mask that fits suitably and comfortably. A second category of devices includes a float or board having a viewport in a forward portion thereof through which the user may observe objects under water. An example of such a device is disclosed in U.S. Pat. No. 3,081,726, issued Mar. 19, 1963, to William M. Betts, et al. A hollow, fiberglass float is disclosed in this patent, the float having a viewport through the float with a pane of glass at the bottom and a generally circular, upwardly extending turret rimmed with a soft, rubber face pad. A plurality of air breather holes are formed through the upper portion of the turret to provide fresh air for the user. In addition to the expense of such a device, the amount of fresh air available within the turret during use of the device is subject to question. If the supply of fresh air becomes inadequate, excess carbon dioxide from exhalation builds up within the turret and the continued rebreathing of such stale air eventually leads to a headache, at the very least. Additionally, such devices are constructed to be ridden by the user and thus are quite bulky.

Conversely, the present invention provides an entirely novel category of underwater devices which are used very easily, require little or no training to be used, and are of uncomplicated structure. The underwater viewing device of the present invention also includes ventilation openings and air circulation structure so that an adequate supply of fresh air is assured during use of the device. The device of this invention will float in a stable, upright attitude when unattended and will support a user with his head out of water whether the user or swimmer is in a vertical or horizontal attitude in the water.

SUMMARY OF THE INVENTION

Accordingly, it is a principal object of this invention to provide an underwater viewing device to uncomplicated, one-piece construction, the device being made of transparent material and including an opening which will accommodate any user's face quite comfortably.

It is another object of the invention to provide an underwater viewing device which includes air ventilation and circulation structure so as to assure a constant supply of fresh air for the user.

It is a further object of the invention to provide an underwater viewing device having graspable handles and which will float in a stable, upright attitude in the water when left unattended and further will support a user whether the user is in a vertical or horizontal attitude.

It is yet another object of the invention to provide an underwater viewing device in the form of a generally rectangular container having a transparent bottom and an open top rimmed by a pad of flexible, soft material against which a user's face may be comfortably seated.

It is yet a further object of the invention to provide an underwater viewing device in the form of an open-top, transparent container having ventilation openings formed through the front and rear walls thereof, and further having handles in the form of graspable bulbs with tube extensions ending within the forward, bottom area of the container, whereby when the bulbs are periodically squeezed, air within the container is caused to circulate from front to rear and thus draw fresh air in and exhaust stale air out of the device.

Still another object of the invention is to provide an underwater viewing device which is compact in size, low in cost of manufacture, and very easy to learn to use.

Further novel features and other objects and advantages of this invention will become readily apparent from the following detailed description, discussion and the appended claims, taken in conjunction with the accompanying drawings.

BRIEF DESCRIPTION OF THE DRAWINGS

A preferred structural embodiment of this invention is disclosed in the accompanying drawings in which.

DESCRIPTION OF THE PREFERRED EMBODIMENT

Figure 1:
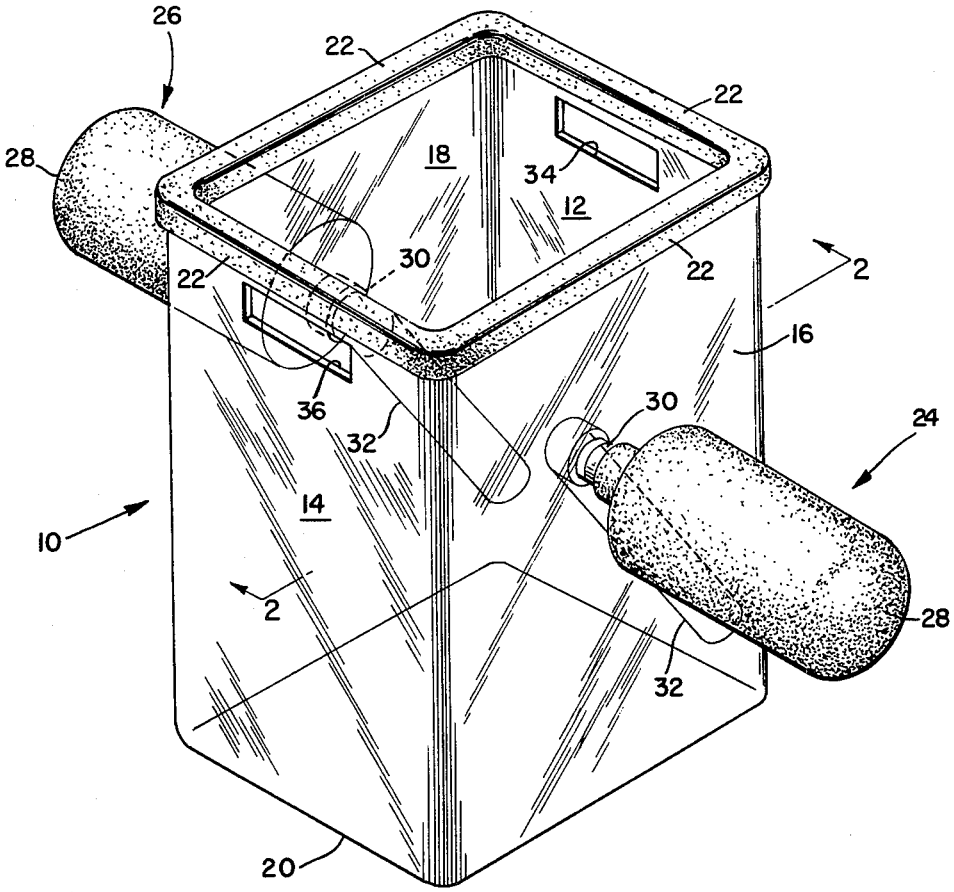
FIG. 1 is a generally top, perspective view of the invention.
Figure 2:
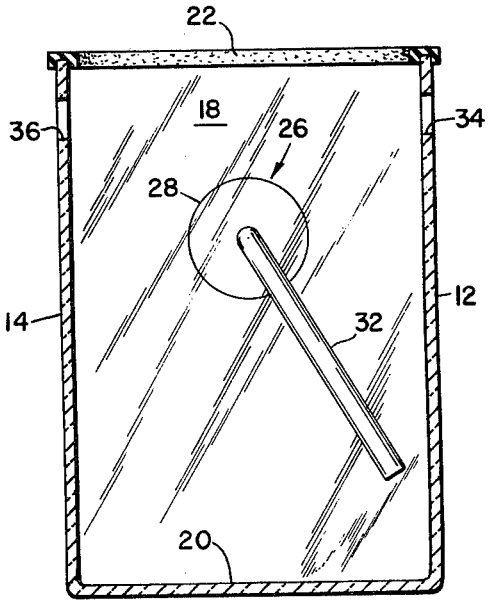
FIG. 2 is a section view of the invention, taken along lines 2—2 of FIG. 1.

Referring now to the drawings by reference character, the underwater viewing device of this invention is in the form of a generally one-piece, transparent container 10 having a front wall 12, a rear wall 14, and side walls 16 and 18. A bottom wall 20 is transparent so that objects under water may be seen therethrough from the open top of the container which is in the form of a flat, peripheral surface. Preferably, the top of the container is surmounted by a peripheral padding 22 of soft, flexible material such as foam rubber against which the face of a user may be comfortably seated. In this preferred embodiment, the opening is about 10" long and about 8" wide. With these dimensions, virtually anyone may use the device, regardless of his or her particular facial size and features.

Preferably, the container 10 is of one-piece construction, being made of suitable, unbreakable, transparent plastics material. The material selected may be one from a wide variety of plastics materials well-known in that art.

A pair of graspable handles 24,26 are provided on side walls 16, 18, respectively, of container 10. Each handle includes a hollow bulb 28 of flexible material mounted upon a short length of tubing 30, formed through the side wall of container 10. Interiorly of the container, the tubing 30 includes a tubing extension 32 angled forwardly and downwardly, and terminating near the forward, bottom area of container 10. When the bulbs 28 are periodically squeezed by the user, any air in the forward, bottom area of the container is caused to circulate to the rear of the container 10. Additionally, front wall 12 of the container 10 includes an opening 34 in the upper portion thereof and rear wall 14 includes a similar opening 36 in the upper portion thereof. Thus, the openings 34 and 36 provide an inlet port and an exhaust port for air, respectively, and periodic squeezing of the bulbs 28 assures that fresh air from opening 34 is circulated rearwardly and out of the exhaust or rear opening 36. Thus, it is assured that the user is provided with a more than adequate supply of fresh air while using the device. Additionally, this constant supply of fresh air minimizes or eliminates fogging on the bottom wall 20 so that the transparency of the bottom wall 20 is not compromised.

The container is structured so that handles 24 and 26 will be located at the water line of the device when it is left unattended. In this way, the handles 24, 26 act as stabilizing outriggers so as to assure that the device remains in a vertical attitude in the water. This stabilizing feature further assures that water will not be shipped into the device and possibly cause it to sink. Further, the device will support a user whether the user or swimmer is in a horizontal or vertical attitude in the water. The device is very comfortable to use because the user or swimmer simply puts his face against the open top of the container, upon the comfortable, peripheral padding 22. Further comfort for the user is assured because nothing needs to be tightly fitted against the face, such as the skirt of a conventional diving mask and nothing needs to be inserted in the mouth, such as a conventional snorkel, for breathing purposes. The air circulation and ventilation structure provided assures a ready supply of breathable air and further assures that carbon dioxide will not accumulate within the container. The viewing device is of sturdy construction and of sufficient size so that the user's head and shoulders are supported above the water with the face and hair comfortably dry. The device is sufficiently bouyant so that no swimming effort is required of the user and, in fact, the device actually functions as a safety float. The device even provides safe underwater viewing for non-swimmers because the only skill required in use of the device is to remember to periodically squeeze the bulb to keep the supply of air fresh.

Since the body of the device or viewer is transparent, the viewer thus affords peripheral vision to the user so that objects to the sides, front and rear of the viewer may be seen under water.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

What is claimed and desired to be secured by Letters Patent is:

1. An underwater viewing device comprising: an open-topped, hollow, walled, generally rectangular container of one-piece, solid wall construction, the entire container being made of transparent, inflexible plastics material, and having a base or bottom and sides through which a user may see beneath the water, the container being constructed so as to float on the surface of the water with the open top thereof being positioned out of the water; a peripheral surface defined about said open top of said container, against which a user's face may be comfortably seated so that the user may see through said container's transparent bottom and sides; a pair of handles on opposite sides of the container adapted to be grasped by the user, each of said handles comprising a short length of hollow tubing, mounted exteriorally through a side of the container, and a flexible, squeezable bulb mounted on the tubing which, when squeezed periodically by the user, causes air within the container to be circulated, each short length of tubing further comprising a tube extension interiorally of the container and angled downwardly towards a forward, bottom area of the container, whereupon periodic squeezing of the exterior bulb associated therewith causes air to circulate from the front to the back of said container, said handles being so located as to act as stabilizing outriggers when said device is floating free in the water, the container being so constructed that said handles will be positioned at the free floating waterline of the device when it is placed in water; and ventilation means in said container for assuring a constant supply of fresh air within said container and for minimizing the possibility of fogging of the interior of the container while said underwater viewing device is being used.

2. The underwater viewing device as claimed in claim 1 wherein said peripheral surface about the open top of said container includes a padding of soft, flexible material entirely therearound against which the face of a user may be comfortably placed.

3. The underwater viewing device as claimed in claim 1 wherein said ventilation means comprise an opening defined through an upper, forward portion of said container and an additional opening defined through an upper, rear portion of said container.

4. An underwater viewing device comprising: an open topped, generally rectangular, one-piece walled container made of inflexible plastics material; a peripheral surface defined about said open top of said container; a padding of soft, flexible material located entirely about said peripheral surface against which the face of a user may be comfortably placed; a pair of handles on each side of the container, each handle comprising a short length of tubing exteriorly through a side of the container and a flexible, squeezable bulb mounted on the tubing, the tubing including a tube extension interiorly of the container angled downwardly towards a front, bottom area of the container whereby when the bulb is periodically squeezed, air is caused to circulate from the front to the rear of the container; and ventilation means comprising an opening defined through the upper, forward wall of the container and a second opening defined through the upper, rear wall of the container; the container being so constructed that said handles will be positioned at the free floating waterline of the device and function as stabilizing outriggers when the device is floated freely in water.

* * * * *